United States Patent [19]

Toda et al.

[11] 4,172,654

[45] Oct. 30, 1979

[54] APPARATUS FOR CONTROLLING THE ROTATION OF A PHOTOSENSITIVE DRUM OF AN ELECTROPHOTOGRAPHIC APPARATUS

[75] Inventors: Tadayoshi Toda, Minami-Minowa; Muneo Kasuga, Hachioji, both of Japan

[73] Assignee: Olympus Optical Company Limited, Tokyo, Japan

[21] Appl. No.: 891,765

[22] Filed: Mar. 30, 1978

[30] Foreign Application Priority Data

Apr. 2, 1977 [JP] Japan ..... 52-36967

[51] Int. Cl.[2] ..... G03G 15/00

[52] U.S. Cl. ..... 355/14; 355/3 SC

[58] Field of Search ..... 355/3 R, 3 SC, 3 DR, 355/14

[56] References Cited

U.S. PATENT DOCUMENTS

| | | | |
|---|---|---|---|
| 3,873,196 | 3/1975 | Ogawa | 355/3 R |
| 3,916,167 | 10/1975 | Cook | 355/14 X |

*Primary Examiner*—Fred L. Braun

*Attorney, Agent, or Firm*—Haseltine, Lake & Waters

[57] ABSTRACT

In an electrophotographic apparatus including a photosensitive screen drum there is produced a rotation signal each time the screen drum rotates one revolution beginning with a second revolution and the drum is stopped by an $n^{th}$ rotation signal, so that the drum is rotated through (n+1) revolutions when n copies are formed from the same document. During the first revolution of the screen drum, an electrostatic charge latent image is formed on the drum and during the successive n revolutions the latent image is repeatedly transferred to form n copies. A resetting operation of a copy number setting dial is initiated from the second revolution by the first rotation signal.

4 Claims, 6 Drawing Figures

APPARATUS FOR CONTROLLING THE ROTATION OF A PHOTOSENSITIVE DRUM OF AN ELECTROPHOTOGRAPHIC APPARATUS

BACKGROUND OF THE INVENTION

1. Field of the Invention

The present invention relates to electrophotography and more particularly to apparatus for controlling the rotation of a photosensitive drum in the case of printing a plurality of duplicated copies from the same document.

2. Prior Art

It is known to rotate a photosensitive drum through (n+1) revolutions in the case of printing n copies from the same document. For instance, in U.S. Pat. No. 3,819,261 it is disclosed that in the case of forming n copies using a photosensitive drum having a circumference slightly greater than the length of a document, the drum is rotated through (n+1) revolutions. But in this case, during the first n revolutions, n copies are formed and during the last $(n+1)^{th}$ revolutions, the drum is cleaned in preparation for copying another document. It is also known from a Japanese Laid-open Utility Model Application Publication No. 40,229/75 that when it is required to form n copies from the same document, at the end of an $n^{th}$ revolution of a photosensitive drum, a delay timer is actuated so as to effect an $(n+1)^{th}$ rotation of the drum.

As disclosed in the known teachings, during the first n revolutions of the drum, n copies are printed and during the last $(n+1)^{th}$ revolution the preparation for a next copying operation is effected. However, such a measure could not be applied to an electrophotographic apparatus having a photosensitive screen drum, because in this case the screen drum should be biased differently between an electrostatic charge latent image forming step and a charge transferring step and thus these steps must be carried out during different revolutions of the screen drum. For example, during a first revolution of the drum, the latent image forming step is effected and during n successive revolutions the latent image transferring step is repeatedly carried out. In this manner the last copy is formed by the last $(n+1)^{th}$ revolution of the screen drum. Therefore, a copy number set dial should not be reset by the first revolution of the drum and the resetting operation should be initiated from the second revolution. By means of the known drum rotation control apparatuses such a control could not be practised.

SUMMARY OF THE INVENTION

It is an object of the invention to provide an apparatus for controlling the rotation of a photosensitive screen drum in such a manner that a copy number set dial is not reset by a first revolution of the drum and a resetting operation of the dial is initiated beginning with the second revolution of the drum.

An apparatus for controlling the rotation of a photosensitive screen drum of an electrophotographic apparatus according to the invention comprises means for setting manually a given number of copies n to be formed from the same document;

means for resetting said copy number setting means in a stepwise manner each time a respective copy is formed;

means for detecting the rotation of the screen drum and producing a rotation signal each time the screen drum rotates through one revolution beginning with the second revolution;

means for supplying said rotation signal to said resetting means so as to initiate the resetting of the copy number setting means beginning with the second revolution of the screen drum; and means for stopping the rotation of the screen drum by the $n^{th}$ rotation signal so as to rotate the screen drum through (n+1) revolutions.

DESCRIPTION OF THE PREFERRED EMBODIMENTS

Figure 1:
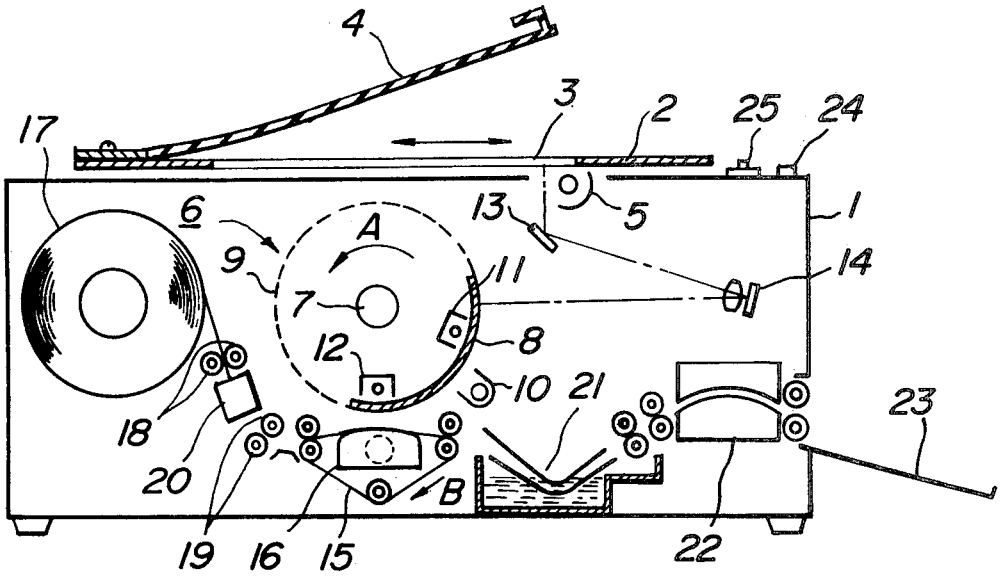
FIG. 1 is a schematic view showing diagramatically an electrophotographic apparatus having a photosensitive screen drum to which a drum rotation control method according to the invention can be advantageously applied.

FIG. 1 is a schematic view illustrating an embodiment of an electrophotographic apparatus having a photosensitive screen drum to which the drum rotation control method according to the invention can be advantageously applied. The electrophotographic apparatus comprises a housing 1 on a top plate of which is arranged slidably a document table 2 having a transparent glass window 3 and a flexible opaque cover 4. Underneath the document table is an illumination lamp device 5. In the housing 1 there is further provided a photosensitive screen drum 6 which is rotatably supported by a shaft 7. The screen drum 6 comprises a frame 8 and a screen 8 which is composed of a metal mesh plate, and a photoconductive layer, an insulating layer, a conductive layer, etc. applied on the mesh plate. Along the circumference of the screen drum 6 there are arranged an electrostatic charge erasing lamp device 10, a first corona charging device 11 for uniformly charging the screen drum and a second corona charging device 12 successively viewed in the rotational direction of the screen drum 6 shown by an arrow A. After the first corona charging device 12 there is provided an optical image projection region in which light reflected by a document (not shown) on the table 2 is projected onto the screen drum 6 by means of a mirror 13 and an in-mirror lens 14. The first corona charger 11 may be provided outside the screen drum 6.

Opposite the second corona charger 12 with respect to the drum there is further provided a paper feeding endless belt 15 which is driven in the direction shown by arrow B. Inside a space formed by the belt 15 there is arranged a backplate 16 which also acts to suck a paper through a duct shown by a dotted line. Between the second charger 12 and the backplate 16 there is formed a transfer region into which is introduced paper fed from a roll paper 17 by means of a pair of paper feed rollers 18, 19 and cut by a cutter 20. The paper having an electrostatic charge latent image transferred thereto is further fed to a development device 21 and a fixing device 22 successively and a final copy with a toner image fixed thereto is collected on a tray 23. In this embodiment, the development is effected with toners suspended in liquid, but it is of course possible to carry out the development operation with dry toners by utilizing, for instance, a magnetic brush.

Since the mechanism and steps for forming a duplicated copy using the photosensitive screen drum are known a detailed explanation thereof is omitted. It should be noted that in order to form a duplicated copy, it is necessary to apply bias voltages to the photosensitive screen during the uniform charging and transferring steps. In general, these bias voltage values have to be different from each other and in some cases the polarity of the screen bias voltage has to be changed between the uniform charging and transferring steps. Therefore, the charging and transferring steps could never be carried out simultaneously. Thus, even in the case of forming a single copy, the screen drum 6 must be rotated through two revolutions. That is, in a first revolution of the screen drum 6, the electrostatic charge latent image is formed on the drum and in a second revolution a corresponding electrostatic latent image is formed on the paper on the basis of the latent image formed on the drum 6. If it is required to make a plurality of copies n by repeating only the transfer step for the latent image once formed on the screen drum 6, the drum has to be rotated through $n+1$ revolutions. In this case, during a first revolution the latent image is formed on the screen drum 6 and after that during every revolution a respective copy is obtained. Thus, during the final $(n+1)^{th}$ revolution the final $n^{th}$ copy is formed.

On a front panel of the housing 1 there are provided a print start button 24 and a dial 25 for setting the number of copies to be printed. The dial 25 has the numbers "1", "2", "3" . . . marked thereon and when a plurality of copies is selected by rotating the dial over a given angle, the dial is reset or returned toward an initial single copy position in a stepwise manner every time a copy is formed. In this case, since the first copy is printed during the second revolution of the screen drum, the resetting operation of the dial should be initiated from the second revolution and during the $(n+1)^{th}$ revolution, the dial is returned to its initial single copy position.

Figure 2:
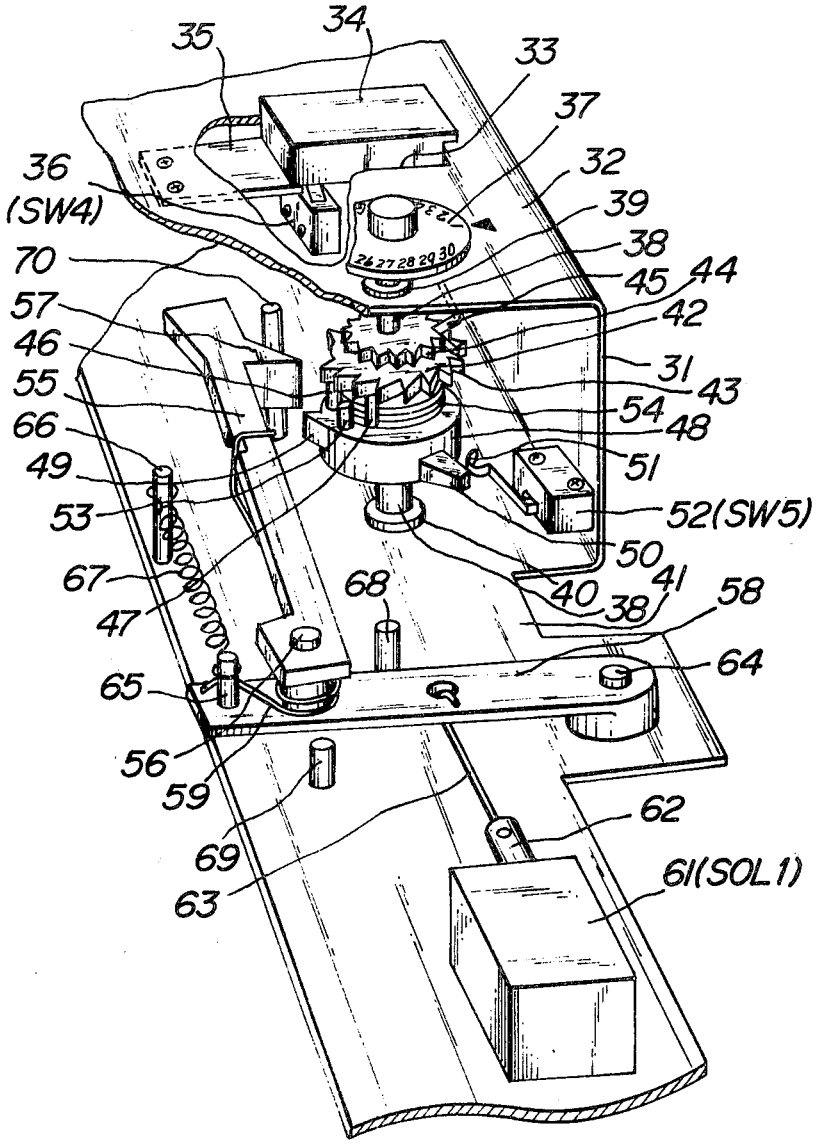
FIG. 2 is a perspective view illustrating an embodiment of a copy count set dial driving mechanism.

FIG. 2 is a perspective view illustrating an embodiment of a mechanism for resetting the copy number setting dial in the manner described above. Reference numeral 31 denotes a frame which may be a part of the housing 1 (see FIG. 1) of the electrophotographic apparatus or may be secured to the housing 1. The frame 31 has a top plate 32 in which is formed a retangular opening 33. Through the opening 33 a print start button 34 projects so as to be able to actuate it from the outside. The button 34 is resiliently supported by a leaf spring 35. Underneath the button 34 there is provided a print switch or print start micro switch 36 which is turned "ON" only when the print start button 34 is depressed. That is the switch 36 is a normally open switch.

On the top plate 32 of the frame 31 there is also provided a copy number set dial 37 for setting the number of duplicated copies to be formed successively from the same document. The dial 37 is secured to a shaft 38 which is supported rotatably by means of a pair of bearings 39 and 40 secured to the top plate 32 and a bottom plate 41, respectively. To the dial shaft 38 there is fixed a ratchet wheel 42 having a number of ratchet teeth 43, the number of which is equal to the maximum number of copies, in this embodiment thirty copies.

Above the ratchet wheel 42 there is separately or integrally provided click teeth 44 which engage a click pawl 45 formed by a leaf spring so as to provide a clicking sound during the rotation of the ratchet wheel 42. On an opposite surface of the ratchet wheel 42 which is remote from the click teeth 44 there are provided a pair of pins 46 and 47. As will be explained later these pins are separated from each other.

Mounted on the dial shaft 38 is a cam plate or cam disc 48 which can rotate freely about the shaft 38. On a cam surface of this cam plate 48 there are formed a single ratchet tooth 49 which has the same configuration as the ratchet tooth 43 and a projection 50 which can engage with an actuating arm 51 constituted as a leaf spring for a normally open micro-switch 52.

On an upper surface of the cam plate 18, there is secured a pin 53 which is positioned between the pins 46 and 47 on the ratchet wheel 42 so that when the cam plate 48 rotates with respect to the ratchet wheel 42, the pin 53 can engage with the pin 46 or 47. The spacing between the pins 46 and 47 is so determined that the cam plate 48 can rotate over the single ratchet tooth 43 of the ratchet wheel 42.

Figure 3A:
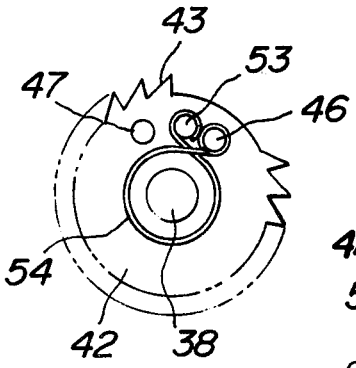
FIG. 3A and FIG. 3B are plan views depicting a relative position of a ratchet wheel and a cam plate shown in FIG. 2.
Figure 3B:
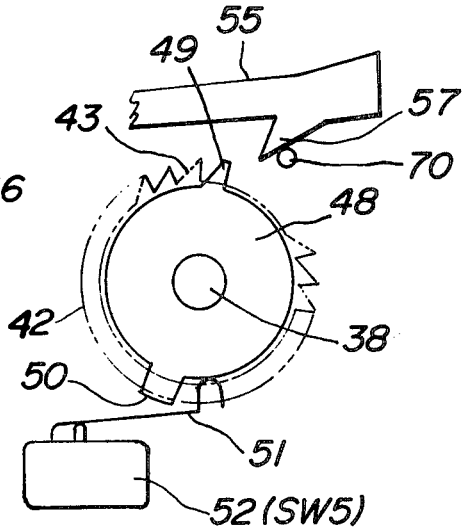

Between the ratchet wheel 42 and the cam plate 48 there is arranged a coil spring 54 both ends of which are fixed to either one of the pins 46 and 47, in this case pin 46 and to the pin 53, respectively as clearly shown in FIG. 3A. The coil spring 54 is so constructed that the cam plate 48 is forced to rotate with respect to the ratchet wheel 42 in the clockwise direction viewed from the set dial 37 and thus the pin 53 is always engaged with the pin 46. As shown in FIG. 3B, the cam plate 48 and the ratchet wheel 42 are so positioned that the single ratchet tooth 49 of the cam plate 48 deviates by one tooth pitch with respect to the first ratchet tooth 43 of the ratchet wheel 42 which corresponds to the copy number "1" in a clockwise direction viewed from the set dial 37.

As shown in FIG. 2 there is further provided an operating arm 55 which is pivotably supported by a pin 56 and has near its free end a large pawl 57 which can engage simultaneously both the ratchet tooth 43 of the ratchet wheel 42 and the tooth 49 of the cam 48. The pin 56 is secured to a lever 58 and between the arm 55 and lever 58 there is provided a coil spring 59. Thus, the arm 55 is forced to rotate in the clockwise direction, but this rotational movement is restricted by a pin 70 as will be explained in greater detail. The lever 58 is rotatably supported by a pin 64 to the bottom plate 41 of the frame 31. On the bottom plate there is further secured a solenoid 61 and its plunger 62 is coupled with the lever 58 by means of a hook 63. At a free end of the lever 58 there is provided a pin 65 and on the bottom plate 41 of the frame 31 where is also fixed a pin 66. Between the pins 65 and 66 there is provided a coil spring 67 and thus the lever 58 is forced to rotate about the pin 64 in the clockwise direction viewed from the top plate 32. This rotational movement is restricted by a stopper 68 secured to the bottom plate 41.

When the solenoid 61 is energized, the lever 58 is rotated in the counter-clockwise direction against the force of the spring 67. This rotation is limited by a stopper 69 fixed to the bottom plate 41.

In the rest condition shown in FIG. 2, as long as the solenoid 61 is not energized the lever 58 engages with the pin 68 due to the pulling force of the spring 67. In this condition, the pawl 57 engages with the pin 70 at its inclined edge and thus the arm 55 is slightly rotated in the counter-clockwise direction against the force of the spring 59. In this position of the arm, its pawl 57 does not engage either the ratchet teeth 43 or the tooth 49 as shown in FIG. 3B. Thus, it is possible to rotate the dial 37 in the clockwise direction so as to set a given copy number. In this case, the cam 48 as well as the ratchet wheel 42 are also rotated without contacting the pawl 57. When the solenoid 61 is energized and the lever 58 is rotated in the counter-clockwise direction, the arm 55 is rotated in the clockwise direction and the pawl 57 is brought into engagement with the ratchet tooth 43. Then the ratchet wheel 42 is rotated in the counter-clockwise direction over one pitch of the ratchet tooth. In this case, the set dial 37 and the cam 48 are also rotated over one pitch. In this manner, the dial 37 is reset to the initial single copy position in a stepwise manner every time the solenoid 61 is energized.

Next an electric circuit for energizing the solenoid 61 every time the screen drum rotates over one revolution will be described. As explained above, during the first revolution a copy is not formed and thus the solenoid 61 should not be energized. The energization of the solenoid has to be initiated from the second revolution of the screen drum 6.

Figure 4:
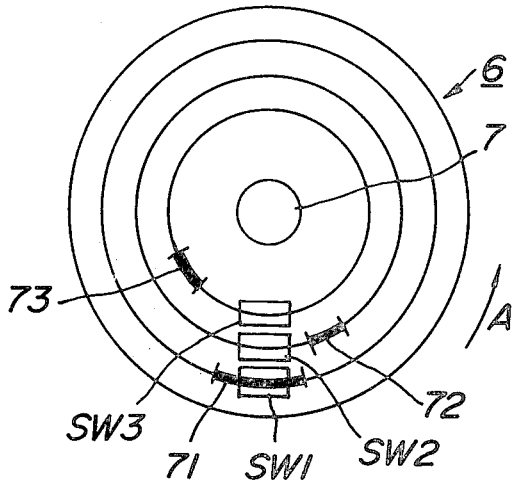
FIG. 4 is a plan view showing a switch assembly.

FIG. 4 is a side view of the screen drum 6 shown in FIG. 1. The screen drum 6 is rotated about the shaft 7 in the direction shown by arrow A. On a side wall of the screen drum 6 there are provided three actuating members 71, 72 and 73 which actuate micro switches SW1, SW2 and SW3, respectively. The screen drum 6 is stopped at such a position that the member 71 actuates the switch SW1. Thus, this switch SW1 may be called a drum stop switch. The micro switch SW2 which is actuated by the member 72 serves to detect the revolutions of the drum 6 after the second revolution. The actuating member 72 for this switch SW2 is positioned slightly forward with respect to the stop switch actuating member 71 viewed in the rotational direction A of the drum 6. The switch SW3 serves to reset the copy number setting dial 37 shown in FIG. 2 and its related actuating member 73 is positioned slightly rearward with respect to the member 71 viewed in the rotational direction A.

Figure 5:
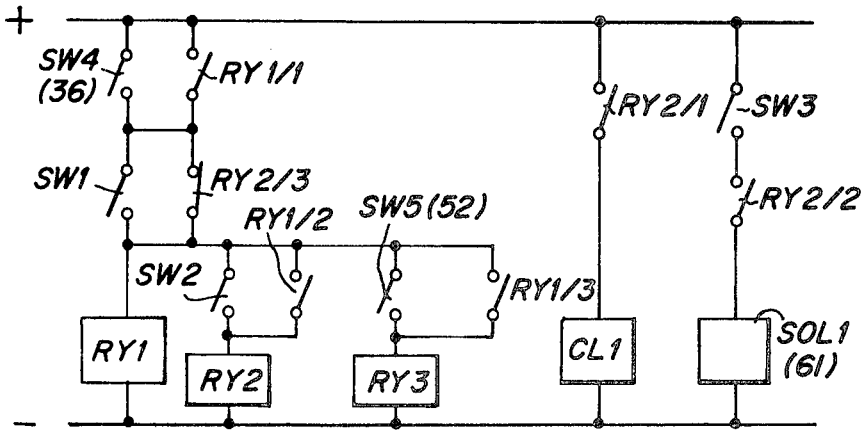
FIG. 5 is a circuit diagram of an embodiment of a drum rotation control circuit.

FIG. 5 is a circuit diagram of a control circuit which can control the rotation of the screen drum 6 together with the mechanism shown in FIG. 2 and the switch assembly of FIG. 4. The arrangement illustrated in FIG. 5 is the rest condition of the screen drum shown in FIG. 4. In this rest condition since the member 71 actuates the drum stop switch SW1, the circuit remains inoperative. A print start switch SW4 (which is the same as the switch 36 in FIG. 2), a counter switch SW5 (which is the same as the switch 52 in FIG. 2), the switch SW2 and the resetting switch SW3 all remain in the "OFF" state. The print start switch SW4 is turned "ON" only when the print start button 34 is depressed and is turned "OFF" when the button 34 is released. The copy count switch SW5 (52) is usually turned "OFF" and is turned "ON" by the projection 50 of the cam 48 when the solenoid 61 is energized in case of the copy number set dial 37 is in "1" position. That is to say the switch SW5 serves to detect the last copy.

Now the operation of the drum rotation control apparatus will be described. It is assumed that although the screen drum 6 is stopped as shown in FIG. 4, an electric motor (not shown) for driving the drum is rotating. Between the drum and the motor there is provided an electromagnetic clutch CL1 (FIG. 5). When the clutch is energized, the drum 6 is connected to the motor and is rotated. After a short time from the deenergization of the clutch CL1, the drum is stopped by means of a suitable braking mechanism.

Now the case of setting the copy number dial 37 to a single copy "1" will be described. The print start switch SW4 is turned "ON" upon the depression of the print start button 34. Then a current flows from a positive terminal of a voltage supply source through the switch SW4, a normally open contact RY1/1 of a relay RY1, a normally closed contact RY2/3 of a relay RY3 and the relay RY1 to a negative terminal of the supply source. Thus, the relay RY1 is energized and its contacts RY1/1 and RY2/1 are closed so as to self-hold the relay RY1. When the relay contact RY2/1 is closed, the clutch CL1 is energized and thus the screen drum 6 is rotated. During this first revolution of the drum 6, an electrostatic charge latent image is formed on the screen drum 6. As can be seen from FIG. 4, when the drum begins to rotate, the member 73 actuates the switch SW3. But at this time normally open contact RY2/2 of a relay RY2 is not turned "ON" and thus the solenoid SOL1 (which is the same as the solenoid 61 shown in FIG. 2) is not energized. Therefore, the copy count dial 37 is not reset during the first revolution of the drum 6.

Near the end of the first revolution of drum, the member 72 actuates the switch SW2. Then the relay RY2 is energized and its normally open contacts RY1/2 and RY2/2 are closed. Then the relay RY2 remains energized. At the end of the first revolution of the drum, the switch SW1 is turned "OFF" by the member 71, but the relays RY1 and RY2 remain in the energized condition because the contact RY2/3 of the relay RY3 is still closed.

After the drum has been rotated through one revolution, the switch SW3 is actuated by the member 73. At this instance since the contact RY2/2 is closed the solenoid SOL1 is energized. Then the arm 55 is pulled forward and thus the ratchet tooth 49 is pulled by the pawl 57 of the arm 55. Then the cam plate 48 is rotated in the counter-clockwise direction viewed from the dial 37. Since the first tooth 43 of the ratchet wheel 42 does not engage the pawl 57 as shown in FIG. 3B, the ratchet wheel 42 and thus the dial 37 do not rotate. Upon the rotation of the cam plate 48, the switch SW5 (52) is momentarily actuated by means of the projection 50 and the actuating leaf spring 51. When the switch SW5 is closed, the relay RY3 is energized so as to close its self-holding contact RY1/3 and the normally closed contact RY2/3 is opened. Even if the contact RY2/3 is opened, the relays RY1, RY2 and RY3 are all energized through the contact RY1/1 and the switch SW1.

At the end of the second revolution of the screen drum 6, the switch SW1 is turned "OFF" by the actuating member 71 and thus all the relays RY1, RY2 and RY3 are deenergized and thus clutch CL1 is deenergized so that the drum 6 is stopped. During the second revolution of the drum 6, the latent image on the drum is transferred onto a paper and the latent image on the paper is developed with toners and a toner image thus developed is fixed.

Next an operation of setting the dial 37 into "n" copy position will be explained. The operation during the first revolution of the screen drum is the same as that just described above. This is to say, even when the switch SW3 is actuated, the solenoid SOL1 is not energized, because the normally close contact RY2/2 remains opened.

After the drum has rotated through the first revolution, each time the switch SW3 is closed by the member 73 the solenoid SOL1 is operated and the ratchet wheel 42, the cam plate 48 and the dial 37 are rotated in the counter-clockwise direction in FIG. 2 so as to reset the dial 37 in a stepwise manner. After the switch SW3 has been actuated n times, the switch SW5 is closed by the projection 50 of the cam plate 48 so as to energize the stop relay RY3. Therefore when the switch SW1 is turned "OFF", the drum is stopped. By this time the drum 6 has been rotated through (n+1) revolutions and n copies have been printed.

What is claimed is:

1. Apparatus for controlling the rotation of a photosensitive screen drum of an electrophotographic apparatus comprising copy number setting means for setting manually a given number of copies n to be formed from the same document, said copy number setting means comprising a dial having copy numbers marked thereon, a shaft fixed to the dial, bearing means for rotatably supporting the shaft and a ratchet wheel secured to said shaft and having a plurality of ratchet teeth the number of which is equal to the maximum copy number on the dial;

resetting means for resetting said copy number setting means in a stepwise manner each time a respective copy is formed, said resetting means comprising a pawl which can engage with any one of said ratchet teeth and means for driving said pawl so as to rotate said ratchet wheel in a reset direction over the distance of one ratchet tooth;

means for detecting the rotation of the screen drum for producing a rotation signal each time the screen drum rotates through one revolution after the first revolution;

means for supplying said rotation signal to said resetting means so as to initiate the resetting of the copy number setting means beginning with the second revolution of the screen drum; and means for stopping the rotation of the screen drum by the $n^{th}$ rotation signal so as to rotate the screen drum through (n+1) revolutions, said means for stopping the rotation of the screen drum comprising a cam rotatably supported by said shaft and having a ratchet tooth identical to the ratchet tooth of the ratchet wheel and an actuating member for actuating a switch which stops the rotation of the screen drum upon the actuation; and a resilient member coupling said cam with said ratchet wheel such that the ratchet tooth of the cam deviates by one ratchet tooth pitch from the first ratchet tooth of the ratchet wheel in a rest condition.

2. An apparatus for controlling the rotation of a photosensitive screen drum of an electrophotographic apparatus comprising copy number setting means for setting manually a given number of copies n to be formed from the same document;

resetting means for resetting said copy number setting means in a stepwise manner each time a respective copy is formed;

means for detecting the rotation of the screen drum for producing a rotation signal each time the screen drum rotates through one revolution after the first revolution, said means for detecting the rotation of the screen drum comprising a first switch for detecting stoppage of the drum, a second switch actuated by each rotation of the drum after the first revolution and a third switch for resetting the copy number setting means;

means for supplying said rotation signal to said resetting means to initiate the resetting of the copy number setting means beginning with the second revolution of the screen drum; and means for stopping the rotation of the screen drum by the $n^{th}$ rotation signal so as to rotate the screen drum through (n+1) revolutions.

3. An apparatus according to claim 2, wherein said first, second and third switches are arranged adjacent a side wall of the screen drum in a radial direction and further comprising a first member for actuating the first switch, a second member for actuating the second switch and a third member for actuating the third switch, said first, second, and third members being provided on the side wall of the drum in such positions that the second and third actuating members are preceded and succeeded, respectively with respect to the first actuating member viewed in a rotational direction of the screen drum.

4. An apparatus according to claim 3, wherein said first switch is connected in series with a print start switch and a first relay having a first normally open contact connected across the print start switch and a second normally open switch connected in series with an electromagnetic clutch coupled between the screen drum and its driving source and; across the first relay there are connected a series circuit of the second switch and a second relay having a first self-holding contact connected across the second switch and a second normally open contact connected in series with the third switch and a solenoid for resetting the copy number setting means and a series circuit of a fourth switch actuated in the last revolution of the drum and a third relay having a first self-holding contact connected across the fourth switch and a second normally closed contact connected across the first switch.

* * * * *